United States Patent [19]

Moser et al.

[11] Patent Number: 4,903,787

[45] Date of Patent: Feb. 27, 1990

[54] ROCK DRILL

[75] Inventors: Bernhard Moser, Altshausen; Wolfgang Peetz, Fronhofen-Blitzenreute, both of Fed. Rep. of Germany

[73] Assignee: Hawera Probst GmbH & Co., Ravensburg, Fed. Rep. of Germany

[21] Appl. No.: 284,651

[22] Filed: Dec. 15, 1988

[30] Foreign Application Priority Data

Dec. 16, 1987 [DE] Fed. Rep. of Germany ..... 3742661

[51] Int. Cl.[4] ..... E21B 10/36; E21B 10/44; E21B 10/58; B28D 1/14

[52] U.S. Cl. ..... 175/410; 175/415; 175/420

[58] Field of Search ..... 175/410, 415, 419, 420, 175/414, 412, 413; 76/108 A

[56] References Cited

U.S. PATENT DOCUMENTS

| | | | |
|---|---|---|---|
| 1,106,966 | 8/1914 | Pauli . | |
| 2,673,716 | 3/1954 | Avery . | |
| 2,865,606 | 12/1958 | Farmer . | |
| 3,674,101 | 7/1972 | Chromy | 175/389 |
| 3,760,894 | 9/1973 | Pitifer | 175/419 X |
| 4,294,319 | 10/1981 | Guergen | 175/389 |

FOREIGN PATENT DOCUMENTS

| | | |
|---|---|---|
| 0251220 | 6/1987 | European Pat. Off. . |
| 0281997 | 3/1988 | European Pat. Off. . |
| 763921 | 5/1950 | Fed. Rep. of Germany . |
| 0919402 | 9/1954 | Fed. Rep. of Germany . |
| 2510298 | 9/1976 | Fed. Rep. of Germany . |
| 2841679 | 4/1980 | Fed. Rep. of Germany . |
| 8234241 | 6/1983 | Fed. Rep. of Germany . |
| 3544433 | 12/1985 | Fed. Rep. of Germany . |
| 3426987 | 1/1986 | Fed. Rep. of Germany . |
| 3608861 | 9/1987 | Fed. Rep. of Germany . |
| 3707798 | 9/1988 | Fed. Rep. of Germany . |
| 832238 | 4/1960 | United Kingdom . |
| 2075409 | 11/1981 | United Kingdom . |

*Primary Examiner*—Stephen J. Novosad
*Attorney, Agent, or Firm*—Spencer & Frank

[57] ABSTRACT

A rock drill haivng a drill head with cruciform cutting tips is proposed which has improved chiselling properties in the case of percussive loading in hard rock or the like. For this purpose, the main cutting tip (4) is of a design know per se with secondary cutting tips (7,8) which are arranged transverse thereto and have a roof-shaped cross-section in side elevation. Additional, radially further outward bit points (16) for working the material result from the roof-shaped cross-section of the secondary cutting timps (7,8,) (cf. drawing).

14 Claims, 1 Drawing Sheet

ROCK DRILL

BACKGROUND OF THE INVENTION

1. Field of the Invention

The invention relates generally to a rock drill and more specifically a rock drill for, for example, a hammer drill in accordance with the preamble of claim 1.

2. Discussion of the Background

Rock drills having sintered carbide cutting tips are used for producing bore holes in concrete, masonry, rock or the like. In order to reduce loading and hence the wear of the sintered carbide cutting tip arranged transversely in the drill head, so-called cross-bits have been disclosed, having a main cutting tip extending over the entire diameter of the drill head and sloping in the shape of a roof, and secondary cutting tips arranged transversely to said main cutting tip. A drill of this kind is illustrated, for example, in U.S. Pat. No. 2,673,716, in particular FIG. 2. According to another embodiment in accordance with U.S. Pat. No. 1,106,966, the cruciform cutting tips can also be formed by two tips arranged perpendicular to one another and having corresponding slots.

As illustrated in the first-mentioned US patent, the secondary cutting tips are composed of two parts which, when assembled, would produce a symmetrical, roof-shaped cutting tip. Thus the point of each secondary cutting tip, said point pointing in the drill feed direction, is arranged in as close proximity as possible to the main cutting edge to ensure a continuous transition (U.S. Pat. No. 2,673,716, FIG. 3).

In copending application Ser. No. 07/765.092 filed Mar. 7th, 1988 (Inventor: Bernhard Moser), it was to this end proposed that the points of the secondary cutting tips should be ground down somewhat in order to set back these secondary cutting tips with respect to the main cutting tip in the immediate vicinity of the latter.

DE No. 3,544,433-A1 furthermore discloses a drilling tool having a main cutting edge, passing through the drill head diameter, as well as additional cutting pins which are arranged in radially eccentric fashion.

SUMMARY OF THE INVENTION

The object on which the invention is based is to improve such tools and, in particular, to propose a drill head geometry for a cruciform cutting head which, under percussive or hammering loads, has a higher wear resistance and an improved drill feed. At the same time, the measures should be carried out as economically as possible.

This object is achieved according to the present invention by a rock drill, particularly for hammer drills, having either a single flight or double flight helical shank and a main cutting tip preferably of sintered carbide. This tip extends over the entire diameter of the drill head, has cutting edges, and has the shape of a roof when viewed in side elevation. The rock drill also has secondary cutting tips arranged transverse to the main cutting tips, preferably comprising more than one piece. Accordingly, the cutting head is cruciform shaped, with the secondary cutting tips having a roof shaped cutting element and a bit point enclosing an obtuse angle $\beta$.

If the working conditions of the known drilling tools under heavy loading are considered, in particular under combined percussive and rotary loading in concrete, masonry, rock or the like, it is found that the wear of the drill head and, in particular, of the sintered carbide cutting edge generally increases radially from the inside towards the outside, i.e. the cutting edges of the drill head are subject to greater wear at the outside radically, than radially further inwards. At the center axis of the drill, the cutting rate at a cutting edge during the rotation of the drill is equal to zero. It increases as the radial distance towards the outside increases. In the case of a sintered carbide tool, the cause of the wear lies less in the pure chiselling action in the case of percussive or hammering loads than in the circumferential speeds, which increase with the radius. A drilling tool having a high axial chiselling force and a low drill speed thus wears less rapidly than a drilling tool having a low chiselling force and a high speed.

In the case of percussive or hammering loading, a powerful chiselling effect is produced by a high surface pressure, i.e. the percussive loading must be accomplished with the smallest possible bit area in combination with a high percussive force. In respect of the purely percussive loading, the sintered carbide cutting element proves to be extremely tough and wear-resistant, i.e. in the region of the center axis of the drill where cutting rates are lower than radially towards the outside, little wear occurs.

In order to keep the chiselling effect as great as possible, the surface contact pressure must not be reduced by an increase in area as a result of additional secondary cutting edges. It is thus expedient that only the main cutting tip should be effective in the region of the greatest chiselling effect, i.e. in the region of the drill head point, since said main cutting tip excavates the center of the bore hole like a digger bit. As the diameter of the bore hole increases, the excavation volume becomes greater, requiring additional auxiliary cutting edges as cutting points or bit points with a high penetration capacity. These additional cutting points reduce the wear at the radially further outward cutting ends of the main cutting tip by virtue of additional radial and axial support and guidance.

Accordingly, the invention is based on the realisation that, in the case of purely percussive loading, the chiselling effect is improved if, for the purpose of increasing the surface pressure, the main cutting tip acts independently, without additional secondary cutting elements, at least in the central region of the drill head point. In the radially further outward region, increased wear of the main cutting tip, as a result of the rotary loading with increasing circumferential speed in the radial direction, is avoided by virtue of the additional secondary cutting tips. In order to increase the chiselling effect of the secondary cutting tips in the radially outer region in the case of percussive loading, each secondary cutting tip is, according to the invention, likewise provided with a bit point, this being effected by a roof-shaped configuration of the secondary cutting tip, so that the secondary cutting tip represents a geometrical reduction of the main cutting tip. Thus, in the central region, the point of the roof-shaped main cutting tip acts independently as the drilling tool penetrates into the material to be drilled, due to a high surface contact pressure and hence a good chiselling effect is thereby obtained. It is only in the radially further outward region that the additional action of the roof-shaped secondary cutting tip subsequently comes into effect. The secondary cutting tip then promotes the characteristics of penetration into the material to be worked, likewise with its bit point, leading to an improved disintegrating effect in the rock. The radially further outward region of the main cutting tip is thus relieved by the secondary cutting tip, so that overall less wear occurs with a simultaneous improvement in efficiency.

Advantageous developments and improvements of the rock drill of the present invention are possible by means of the following features.

The design of the drill where the secondary cutting tip is symmetrical has the advantage that, commercially available standard parts available as mass-produced articles can be used. The costs involved in producing the rock drill according to the invention can thereby be considerably reduced. Furthermore, by virture of the use of roof-shaped secondary cutting tips, less sintered carbide material is needed than if the secondary cutting edge were continued as far as the center of the drill head. This too results in a reduction in production costs. Of course, the secondary cutting tip can also be of asymmetrical design, it being possible for the part pointing towards the main cutting tip to be of shorter configuration. However, the bit point of the secondary cutting tip must be retained.

The cutting edges of the main and secondary cutting elements can point in the drill feed direction and lie on a common conical cut surface. Ths is expedient in order to bring the bit point of each secondary cutting tip into action equally and simultaneously with the main cutting tip during penetration into the material to be drilled. By virtue of the bit points of the secondary cutting tips and the corresponding arrangement in the common conical cut surface, the penetration behavior and disintegrating effect are improved.

The axial groove depth for the main cutting tip may be greater than that of the secondary cutting tips. In addition to the saving in sintered carbide material for the secondary cutting tips, this produces the advantage that the groove base of the main cutting tip and that of the secondary cutting tips lie on a different axial level, as a result of which the cross-section of the drill head is not weakened to an unnecessarily great extent by the grooves at one cutting level.

Following the embodiment according to U.S. Pat. No. 1,106,966, the secondary cutting tips can in special cases also be of integral design, having corresponding slots in the main and secondary cutting tip.

The secondary cutting tip may be immediately adjacent to the main cutting tip. This produces advantageous centering of the cutting tips of the drill head, since the circumcircle of the main cutting tip and the secondary cutting tip to form the nominal diameter is in general the same. However, the secondary cutting tip can also be made narrower and be at an interval from the main cutting tip. If each secondary cutting tip were halved once again, the result would be an acute angle for the angle of the cutting edge of the secondary cutting tip. Although this would result in a saving of sintered carbide material, the wear of the respective bit point would increase. The point of each asymmetrical secondary cutting tip should therefore likewise enclose an obtuse angle, like that of the main cutting tip, so that the minimum width is determined thereby.

The cruciform cutting tips, formed by main and secondary cutting tips, may be inserted in a drill head having a square or circular crosssection. The configuration of the drill head then determines the head resistance and the drill dust grooves in the region of the drill head for removing the drillings. In a special embodiment, the secondary cutting tip and/or the main cutting tip can be of zigzag design at their cutting surface in order to form a plurality of bit points for each tip.

BRIEF DESCRIPTION OF THE DRAWINGS

Exemplary embodiments of the invention are illustrated in the drawing and explained in greater detail in the description which follows.

DETAILED DESCRIPTION OF THE PREFERRED EMBODIMENTS

Figure 2:
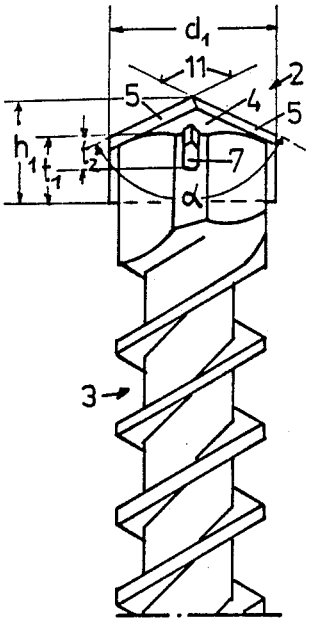
FIG. 2 shows a side elevational view of the drill according to FIG. 1.
Figure 1:
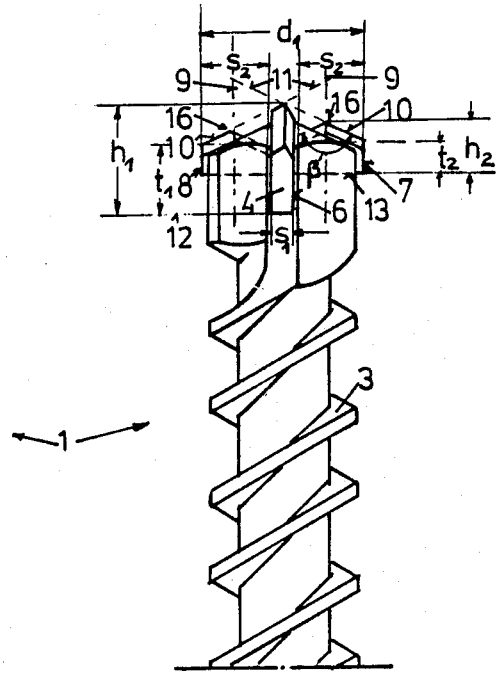
FIG. 1 is an elevational view of a rock drill according to the invention.

In the case of the rock drill (1) illustrated in FIG. 1 in elevation and in FIG. 2 in side elevation, the drill head is designated by reference (2) and the feed screw or the helical shank by reference (3). The feed screw (3) can be of single-flight or 2-flight design.

The drill head (2) has a main cutting tip (4) which extends over the entire diameter d of the drill head, slopes in the shape of a roof and is of a design known per se. The point angle $\alpha$ is designed as an obtuse angle, with a magnitude of $\alpha \simeq 130°$. The main cutting tip (4) has cutting edges (5) as well as a tip thickness $s_1$ and a height $h_1$ and is inserted into a groove (6) having a groove depth $t_1$ in the drill head (2).

According to the invention, the rock drill (1) has two secondary cutting tips (7,8) which are arranged adjacent and transverse to main cutting tip (4). Characteristic of the secondary cutting tips (7,8) are the symmetrical design of these cutting elements with respect to the axis (9) of symmetry and the roof-shaped design of the respective cutting edges (10) having the bit points (16). The conical cut surface (11) of the main cutting tip (see FIG. 2) coincides with the conical cut surface of the secondary cutting tips (7,8) i.e. the cut surfaces of main and secondary cutting tips lie in the same cutting plane. The point angle $\alpha$ of the main cutting tip is approximately equal to point angle $\beta$ of the secondary cutting tips (7,8).

Accordingly, the chiselling effect of the secondary cutting tips (7,8) starts only from the region of the axis (9) of symmetry which has been drawn in, i.e. radially further outward.

The width $s_2$ of each secondary cutting tip (7,8) can be calculated from the summation formula: $d_1 = 2 s_2 + s_1$. At the same time, the brazing gap between the secondary cutting tips (7,8) and the main cutting tip (4) should additionally be considered.

The height $h_2$ of the secondary cutting tips (7,8) is designed to be less than the height $h_1$ of the main cutting tip. This results in a lesser depth $t_2$ of the associated groove. The groove base (12) for the main cutting tip (4) is at a considerably deeper level in the drill head than the groove base (13) of the secondary cutting tips (7,8). A weakening of the cross-section of the drill head is thereby avoided. A preferred value for a ratio of $t_1$ to $t_2$ is about 1 to 2.

Various cross-sectional shapes of the drill head are illustrated in FIGS. 3*a* to *d*. According to FIG. 3a the drill head can have a circular cross-section (14) (drawn in in dashes) or a square cross-section (15). The main cutting tip (4) and the two secondary cutting tips (7,8) arranged transverse thereto are always inserted in this cross-section. The roof-shaped design of the secondary cutting tips results in the radially further outward bit points (16) in the center of the cutting edges (10) of the secondary cutting tips (7,8).

The outside diameter $d_1$ of the main cutting tip (4) normally corresponds to the outside diameter $d_1$ formed by the two secondary cutting tips (7,8). However, in special cases, the nominal diameter $d_1$ formed by the main cutting tip (4) can be greater than the circumcircle diameter of the two secondary cutting tips (7,8).

Figure 3:
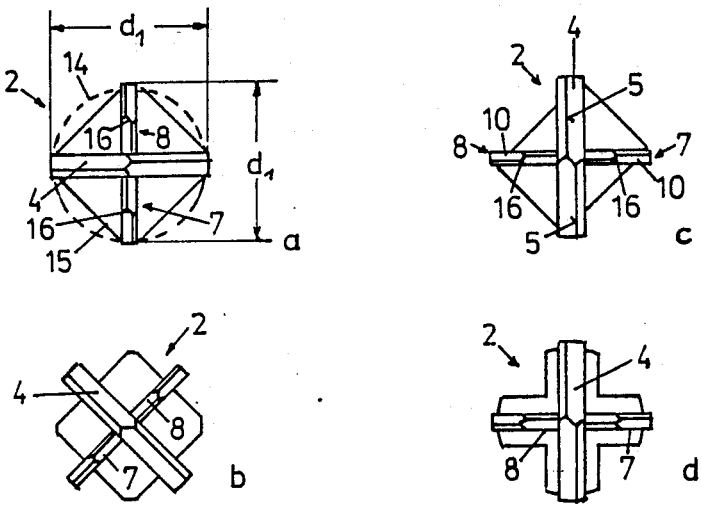
FIGS. 3*a–d* show in cross-section various embodiment variants for a drill head.

In FIG. 3*b*, the main cutting tip (4) and the secondary cutting tips (7,8) are aligned perpendicular to the lateral edges in a drill head (2) of square crosssection instead of the diagonal arrangement according to FIG. 3*a*. This results in larger spaces for the removal of the drillings in the region of the drill head. By virtue of the perpendicular arrangement of the cross-bit to the side faces, the end regions of the main cutting edge and of the two secondary cutting edges protrude far beyond the key surfaces. This results in a large space for drillings immediately in front of the individual cutting elements (4) and (7,8,) of the cross-bit.

The alternative embodiment according to FIG. 3*c* is based on the embodiment according to FIG. 3*a*, but the side faces of what was initially a square cross-section are drawn inwards on two sides, namely in front of the main cutting tip (4), resulting in an enlarged space for drillings in front of the main cutting tip. In other respects, the arrangement of main cutting tip (4) and secondary cutting tips (7,8) is once again evident from FIG. 3*c*, with the cutting edges (5) and (10) formed on the cutting tips and the bit points (16) offset radially outwards, formed by the roof-shaped arrangement of the secondary cutting tips (7,8).

The drill head configuration according to FIG. 3*d* represents a further variant of a cruciform cutting head, the main cutting tip (4) and the secondary cutting tips (7,8) once again being provided in a roof-shaped design. In the preferred exemplary embodiment, all the cutting tips (4 and 7,8) are designed as standard parts, thereby making production cheaper.

We claim:

1. A rock drill, in particular for hammer drills or the like, having a helical shank and having at least one main cutting tip of sintered carbide, said tip extending over the entire diameter of the drill head, sloping in the shape of a roof in side elevation and having cutting edges, and said rock drill having secondary cutting tips, arranged transverse to said main cutting tip and comprising at least one piece, to form a cruciform cutting head, wherein, in side elevation, each secondary cutting tip arranged to the side of the main cutting tip is designed as a roof-shaped cutting element having a bit point enclosing an obtuse angle $\beta$.

2. A drill as claimed in claim 1, wherein the roof-shaped configuration of the secondary cutting tip is symmetrical in design.

3. A drill as claimed in claim 1, wherein the cutting edges of the main and secondary cutting tips, said edges pointing in the drill feed direction, are arranged on a common conical cut surface.

4. A drill as claimed in claim 1, wherein the depth $t_2$ of the groove for the secondary cutting tips is less than the depth $t_1$ of the groove for the main cutting tip, with a ratio $t1/:t_2$ of preferably about 1:2.

5. A drill as claimed into claim 1, wherein the secondary cutting tips are of integral design, with slots in the main and secondary cutting tip.

6. A drill as claimed in claim 1, wherein the secondary cutting tips adjoin the main cutting tip via a brazing gap.

7. A drill as claimed in claim 1, wherein the cruciform cutting tips are arranged in a drill head having a square cross-section.

8. A drill as claimed in claim 1, wherein, at their cutting edges, the secondary cutting tips and/or the main cutting tip are of zigzag design to form a plurality of bit points.

9. A drill as claimed in claim 1, wherein the secondary cutting tip is a geometrical reduction of the main cutting tip.

10. A rock drill as claimed in claim 1, wherein the roof-shaped configuration of the secondary cutting tip is asymmetrical in design.

11. A rock drill as claimed in claim 1, wherein the cruciform cutting tips are arranged in a drillhead having a circular cross-section.

12. A rock drill as claimed in claim 1, wherein the cruciform cutting tips are arranged in a drillhead having a rectangular cross-section.

13. A rock drill as claimed in claim 1, wherein the cruciform cutting tips are arranged in a drillhead having a star-shaped cross-section.

14. A rock drill as claimed in claim 1, wherein the helical shank has a single-flight helix.

* * * * *